United States Patent [19]

Wildey

[11] Patent Number: 4,635,859

[45] Date of Patent: Jan. 13, 1987

[54] FOIL ARRANGEMENT FOR CENTRIFUGAL GRINDER

[75] Inventor: Allan J. Wildey, Brantford, Canada

[73] Assignee: AMCA International Limited, Brantford, Canada

[21] Appl. No.: 739,438

[22] Filed: May 29, 1985

[30] Foreign Application Priority Data

May 9, 1985 [CA] Canada ..... 481168

[51] Int. Cl.[4] ..... B02C 19/12

[52] U.S. Cl. ..... 241/21; 241/28; 241/41; 241/275

[58] Field of Search ..... 241/28, 21, 119, 275, 241/41

[56] References Cited

U.S. PATENT DOCUMENTS 4,474,335 10/1984 Wildey ..... 241/275 X 4,489,895 12/1984 Petersen ..... 241/119 X

*Primary Examiner*—Mark Rosenbaum

*Attorney, Agent, or Firm*—Sim & McBurney

[57] ABSTRACT

A centrifugal grinder with an internal grinding surface and a rotor turning within that surface includes a passage for inserting material axially into the rotor and a pocket to allow the material to contact the internal grinding surface. A spray is provided on the rotor at a location trailing the pocket, to spray liquid against the internal surface and make a slurry with ground material. An element of air-foil shape is mounted on the rotor at a location trailing the spray, the air-foil having a rounded contacting portion juxtaposed against the internal grinding surface, and have the effect of lifting the slurry away from the surface. A scoop trails the foil and has a leading edge juxtaposed against the internal grinding surface, defining a pocket for collecting the scooped-up slurry. A compartment is located axially beyond the grinding surface and a passage allows the scooped up slurry to pass from the pocket of the scoop to the compartment.

6 Claims, 2 Drawing Figures

FOIL ARRANGEMENT FOR CENTRIFUGAL GRINDER

The present invention relates to a method and apparatus for grinding pulpwood and/or wood chips, in which the force urging the wood against the grinding surface arises centrifugally. The present method and apparatus also includes various other features and advantages, which will be dealt with in detail below.

GENERAL BACKGROUND OF THIS INVENTION

One conventional method of producing ground wood pulp for the manufacture of paper products involves pressing a batch of pulpwood (roundwood or wood chips) against a rotating grinding stone while simultaneously feeding shower water into the grinding chamber, specifically by spraying the water directly on the surface of the stone at a location spaced from the actual grinding location. By means of a dam or weir, the formed groundwood stock, which is an aqueous slurry of pulp, is kept in the grinding chamber at a level a little higher than the lower point of the stone in order to clean, lubricate and cool the stone. The ground wood stock flowing over the dam is discharged by its own weight for further treatment. A variant of the foregoing is the "pitless" method, in which the stone is not immersed, and provision is made for extra water showers.

Another known method utilizes a disc refiner, in which material being refined or reduced is worked between two closely spaced opposed discs which undergo relative rotation.

In a recent development, the wood is ground under superatmospheric pressure, thus permitting grinding temperatures higher than in the standard stone groundwood (SWG). In U.S. Pat. Nos. 3,808,090 and 3,948,449, a process is described for improving the groundwood pulp by grinding wood in a closed grinding chamber in a pressurized gaseous atmosphere. In the two patents just named, the wood is fed in and the superatmospheric pressure in the grinding chamber can be maintained only so long as the grinding of a wood batch continues. However, when a new wood batch must be fed into the magazine, the magazine must be opened and the pressure of the grinding surface falls to atmospheric. Thus, the grinder does not work in a continuously pressurized atmosphere.

In an attempt to overcome the problem just defined, additional developments have been made and patented by Oy Tampella Ab, as exemplified in Canadian Pat. No. 1,097,118 issued Mar. 10, 1981, and U.S. Pat. Nos. 4,270,703 and 4,274,600 issued June 2, 1981 and June 23, 1981, respectively. In the Oy Tampella process, a feed chamber upstream of the grinding chamber has two pressure seals, one to the atmosphere and one to the grinding chamber. Thus, the feed chamber acts as a double-lock seal, to allow the pressure in the grinding chamber always to be maintained above atmospheric. By the use of this method, the pressure in the grinding chamber may reach as high as several bar, and temperatures at the grinding stone surface may climb well above the standard pressure boiling point.

Because of the considerable size and complexity of the SGW process and the pressurized groundwood (PGW) process developed hitherto, it would be desirable to reduce the complexity and size of an installation for producing ground pulp that can be used in paper making. In both the PGW and SGW processes, very large pressure shoes must be hydraulically driven to urge the roundwood against the grinding stone, and above the general location of the pressure shoes must be provided a stack for the incoming wood to be ground.

A different approach to the grinding of wood pulp is one in which the grinding pressure between the wood and the grinding surface is brought about centrifugally, by providing an internal cylindrical grinding surface, and by "flinging" the wood outwardly against the stationary grinding surface through the use of centrifugal force. The centrifuging action not only would allow the appropriate pressure to arise between the wood and the grinding surface, but could also pressurize a quantity of water being swept around along with the wood, thus permitting higher temperatures than the maximum attainable in the standard SGW process.

Early Canadian Pat. No. 2835, issued Oct. 24, 1873 to Moore, discloses a primitive version of a centrifugal grinder for wood, which incorporates a stationary internal cylindrical grinding surface, and a rotor turning about a vertical axis, and flinging the feed wood centrifugally outward along radial pathways to contact the grinding surface. Water for cooling the grinding surface and for making up the pulp slurry is simply squirted into the housing by a single hose or pipe.

Because of the primitive construction utilized by Moore, his apparatus would not do for the high speed grinding requirements of the present day.

In my earlier U.S. Pat. No. 4,474,335, issued on Oct. 2, 1984 and entitled "Method and Apparatus for Centrifugal Pulpwood and Wood Chip Grinding", there is described a grinding apparatus which utilizes the rotating principle in order to promote uniform and pressurized water spray against the internal grinding surface. My said earlier patent describes a centrifugal grinder which includes an internal grinding surface in the shape of a surface of revolution, a rotor mounted for rotation coaxially within the grinding surface, the rotor having a central cavity and defining at least one pocket through which material in the central cavity can contact the grinding surface, first means for delivering material to be ground to the central cavity, second means for rotating the rotor and third means in the rotor for applying water to the grinding surface.

While the apparatus described in my earlier patent functions quite satisfactorily, on-going tests have shown the propensity of fibre to stick to the inside surface of the internal pulpstone grinding surface, despite provisions designed to minimize this occurrence.

Accordingly, it is an aim of one aspect of this invention to provide an improved construction for a centrifugal grinder, in which the pulp slurry can be lifted from the stone surface and then caught or collected in a special pocket-defining unit, from which it can be passed to a compartment axially beyond the grinding surface.

More particularly, this invention provides, in combination:

- a grinding stone having an internal grinding surface in the shape of a surface of revolution,
- a rotor within the grinding stone mounted for rotation about the axis of the surface of revolution, the rotor having an axial inlet for material to be ground and pocket means to allow the material to contact the said internal grinding surface,
- spray means mounted on the rotor at a location trailing the said pocket means in the sense of rotation, the spray means adapted to spray liquid against the internal grinding surface to make a slurry with ground material, an element mounted on the rotor at a location trailing the said spray means in the sense of rotation, the element having a rounded outer surface juxtaposed closely with respect to the said internal grinding surface, a scoop means mounted on the rotor and trailing the said element in the sense of rotation, the scoop means having a leading edge juxtaposed against the said internal grinding surface and defining a pocket for collecting the scooped-up slurry, the scoop means being adapted to conduct the slurry toward the axial ends of the grinding stone, means defining an outlet for the slurry, and passage means from the pocket of the scoop means to the said outlet.

Further, this invention provides a method of grinding a material utilizing the combination of a grinding stone having an internal grinding surface in the shape of a surface of revolution and a rotor within the grinding stone mounted for rotation about the axis of the surface of revolution, the rotor having an axial inlet for material to be ground and pocket means to allow the material to contact the said internal grinding surface, and spray means on the rotor for spraying liquid against the internal grinding surface, the method comprising the steps:

(a) rotating the rotor while feeding into the rotor material to be ground, and spraying liquid onto the internal grinding surface to make a slurry with the ground material, (b) at a location trailing the spray means in the sense of rotation, closely juxtaposing with respect to the internal grinding surface an element having a rounded outer surface, thereby to lift the slurry inwardly away from the internal grinding surface, (c) at a location trailing the element in the sense of rotation, scooping the slurry in a scoop means having a leading edge closely juxtaposed with respect to the internal grinding surface, (d) and transferring the scooped-up slurry to a compartment located axially beyond the grinding surface.

GENERAL DESCRIPTION OF THE DRAWINGS

One embodiment of this invention is illustrated in the accompanying drawings, in which like numerals denote like parts throughout the several views, and in which:

FIG. 1 is a cross-sectional view through a centrifugal grinder constructed in accordance with this invention; and FIG. 2 is a perspective view of the rotor of FIG. 1, showing the components which lift and collect the slurry from the internal pulpstone grinding surface.

DETAILED DESCRIPTION OF THE DRAWINGS

Figure 1:
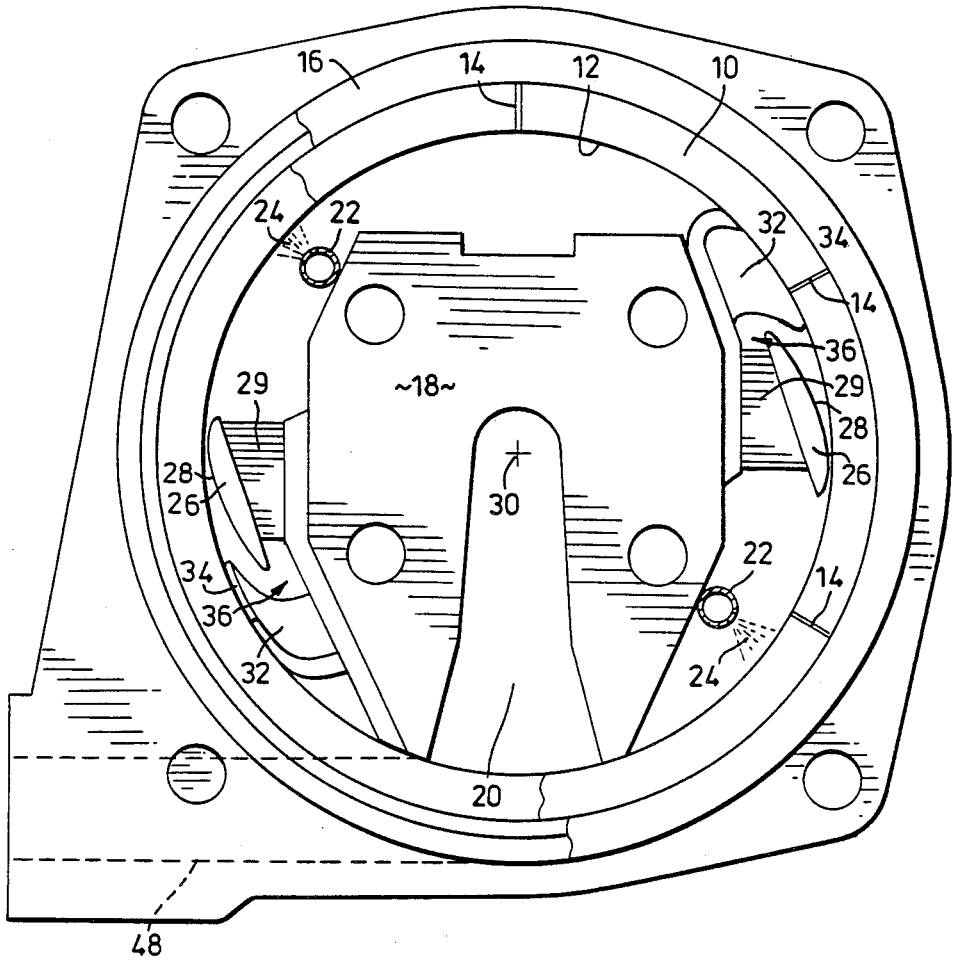

Attention is first directed to FIG. 1, which shows a grinding pulpstone 10 having an internal cylindrical surface 12. The stone 10 is divided into six segments with a plurality of buffers 14 between the segments. The stone is supported in a surrounding cylindrical support 16. Mounted for rotation within the stone 10, about the central axis of the cylindrical internal surface 12, is a rotor 18 which has an axial inlet (not seen in the sectional view of FIG. 1) for the admission of material to be ground, and which has a pocket 20 to allow material admitted through the axial inlet to contact the internal grinding surface 12.

The rotor 18 carries two spray pipes 22 which deliver a distributed spray 24 against the internal grinding surface 12.

In FIG. 1, the rotor 18 is assumed to be rotating in the clockwise sense, and it will be seen that there is provided on the rotor, at a location trailing each of the spray pipes 22, an air-foil 26, having a rounded outer surface 28 extending substantially parallel with the rotor axis 30 and closely juxtaposed with respect to the internal grinding surface 12. Each air-foil 26 is supported from the rotor 18 by two brackets 29. For each air-foil 26 there is provided on the rotor, at a location trailing the respective foil 26 in the sense of rotation, a scoop means 32 which has a leading edge 34 which is closely juxtaposed with respect to the internal grinding surface 12. The scoop means, more particularly, is chevron shaped and is defined by an element which is curved in section, ending at the leading edge 34. The air-foil 26 cooperates with the scoop means 32 to define a chamber 36 which includes a pocket region defined in the crook of the scoop means 32. The chamber 36 extends longitudinally to locations just beyond the axial ends of the rotor 18 and the surface 12, and communicates through suitable passage means (not shown) which lead from the chamber 36 to a tangential outlet 48.

Figure 2:
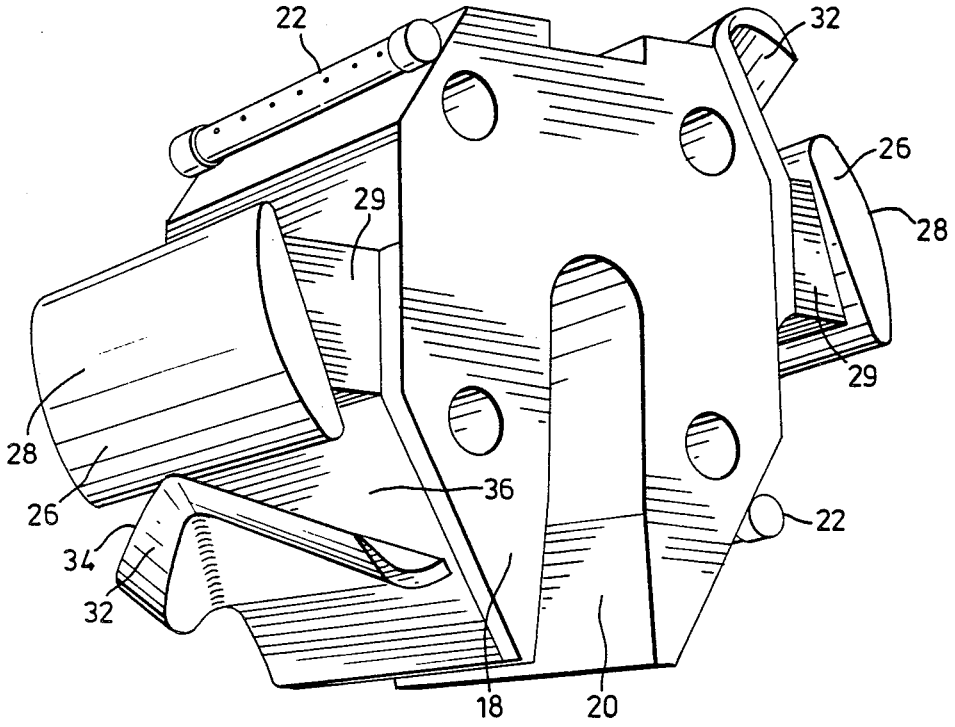

The essential components of the rotor 18, including foil and scoop means, are seen in FIG. 2.

It will thus be understood from the foregoing description taken in conjunction with the appended drawings that, as a slurry of wood pulp is created due to the centrifugal grinding taking place in the pocket 20. As the slurry tends to be distributed over the inside grinding surface 12, the effect of the air-foils 26 is to move closely adjacent though not quite touching the inside surface 12, with the effect of pulling up the slurry (i.e. moving it radially inwardly), so that it moves into the pockets 36 and can be scooped or collected by the scoop means 32. Because of the chevron shape of the scoop means 32, the pulled-up slurry will tend to migrate toward either end of the rotary chamber in which the rotor 18 is turning, where suitable passageway means (not shown) are provided to allow the slurry to exit from the grinding chamber. The nature of such passageway means to allow exit of the slurry is conventional, and need not be detailed in this specification.

While one embodiment of this invention has been illustrated in the accompanying drawings, and described hereinabove, it will be evident to those skilled in the art that changes and modifications may be made therein without departing from the essence of this invention, as set forth in the appended claims.

The embodiments of the invention in which an exclusive property or privilege is claimed are defined as follows:

1. In combination:

a grinding stone having an internal grinding surface in the shape of a surface of revolution, a rotor within the grinding stone mounted for rotation about the axis of the surface of revolution, the rotor having an axial inlet for material to be ground and pocket means to allow the material to contact the said internal grinding surface, spray means mounted on the rotor at a location trailing the said pocket means in the sense of rotation, the spray means adapted to spray liquid against the internal grinding surface to make a slurry with ground material, an element mounted on the rotor at a location trailing the said spray means in the sense of rotation, the element having a rounded outer surface juxtaposed closely with respect to the said internal grinding surface, a scoop means mounted on the rotor and trailing the said element in the sense of rotation, the scoop means having a leading edge juxtaposed against the said internal grinding surface and defining a pocket for collecting the scooped-up slurry, the scoop means being adapted to conduct the slurry toward the axial ends of the grinding stone, means defining an outlet for the slurry, and passage means from the pocket of the scoop means to the said outlet.

2. The combination claimed in claim 1, in which the surface of revolution is a circular cylinder.

3. The combination claimed in claim 1, which further comprises an additional spray means substantially the same as the said spray means, an additional element substantially the same as the said element and an additional scoop means substantially the same as the said scoop means, the additional spray means, element in scoop means having the same relationship as the first-defined spray means, element and scoop means.

4. The combination claimed in claim 1, in which the element is in the shape of an air-foil, and in which the scoop means is chevron-shaped.

5. The combination claimed in claim 4, in which the surface of revolution is a circular cylinder, the combination further comprising an additional spray means substantially the same as the said spray means, an additional element substantially the same as the said element and an additional scoop means substantially the same as the said scoop means, the relationship between the additional spray means, element and scoop means being the same as the relationship between the first-mentioned spray means, element and scoop means.

6. A method of grinding a material utilizing the combinatin of a grinding stone having an internal grinding surface in the shape of a surface of revolution and a rotor within the grinding stone mounted for rotation about the axis of the surface of revolution, the rotor having an axial inlet for material to be ground and pocket means to allow the material to contact the said internal grinding surface, and spray means on the rotor for spraying liquid against the internal grinding surface, the method comprising the steps:

(a) rotating the rotor while feeding into the rotor material to be ground, and spraying liquid onto the internal grinding surface to make a slurry with the ground material, (b) lifting the slurry inwardly away from the internal grinding surface at a location trailing the spray means in the sense of rotation, by closely juxtaposing with respect to the internal grinding surface an element having a rounded outer surface, (c) scooping the slurry in a scoop means having a leading edge closely juxtaposed with respect to the internal grinding surface, at a location trailing the element in the sense of rotation, (d) and transferring the scooped-up slurry to a compartment located axially beyond the grinding surface.

* * * * *